US011011013B2

(12) United States Patent
McKee

(10) Patent No.: US 11,011,013 B2
(45) Date of Patent: May 18, 2021

(54) SYSTEM FOR IDENTIFYING RUNNING STREAK WAGERING EVENTS AND OUTCOMES

(71) Applicant: Robert McKee, Fort Worth, TX (US)

(72) Inventor: Robert McKee, Fort Worth, TX (US)

( * ) Notice: Subject to any disclaimer, the term of this patent is extended or adjusted under 35 U.S.C. 154(b) by 98 days.

(21) Appl. No.: 16/252,560

(22) Filed: Jan. 18, 2019

(65) Prior Publication Data

US 2020/0234528 A1 Jul. 23, 2020

(51) Int. Cl.
*G07F 17/32* (2006.01)

(52) U.S. Cl.
CPC ..... *G07F 17/322* (2013.01); *G07F 17/3213* (2013.01); *G07F 17/3267* (2013.01); *G07F 17/3288* (2013.01)

(58) Field of Classification Search
CPC ..... G07F 17/322; G07F 17/3213; G07F 17/3288; G07F 17/3267
See application file for complete search history.

(56) References Cited

U.S. PATENT DOCUMENTS 5,718,431 A 2/1998 Ornstein
2002/0090988 A1 7/2002 Frost et al.
2004/0116177 A1 6/2004 Frost et al.
2004/0116179 A1* 6/2004 Nicely ..... A63F 3/00157 463/25
2004/0173866 A1 9/2004 Egawa et al.
2005/0261048 A1* 11/2005 Evans ..... G07F 17/34 463/17
2008/0254881 A1 10/2008 Lutnick et al.
2008/0268938 A1* 10/2008 Doutriaux ..... G07F 17/3251 463/17
2012/0034970 A1 2/2012 Stephens
2014/0038687 A1 2/2014 Igt
2016/0218813 A1 7/2016 Farley
2016/0371933 A1 12/2016 Igt
2018/0365926 A9 12/2018 Pececnik

* cited by examiner

*Primary Examiner* — Jasson H Yoo
(74) *Attorney, Agent, or Firm* — Meagher Emanuel Laks Goldberg & Liao, LLP

(57) ABSTRACT

A physical system supports a method on a surface of a gaming table for reception of markers identifying placement of wagers on a series of sequential random outcomes. There are a series of distinct adjacent areas for receiving markers indicating wagers on the series of sequential random outcomes. Each distinct area has a surface area sufficient to accommodate a marker indicating wagers from a single player. Associated with each area is an indicator of a degree of progression through a sequence of random outcomes. The indicator of a degree of progression changing after each sequential outcome. Any markers present on a distinct area moving relative to a last indicator on which any marker was present to indicate a change in a degree of progression in the series of sequential random outcomes.

20 Claims, 11 Drawing Sheets

SYSTEM FOR IDENTIFYING RUNNING STREAK WAGERING EVENTS AND OUTCOMES

BACKGROUND OF THE INVENTION

1. Field of the Invention

The present invention relates to the field of gaming technology, particularly gaming technology with a house employee hosting the gaming event, and especially table games such as roulette games, dice games and playing card games.

2. Background of the Art

Gaming technology involves the placement and the resolution of wagers in an underlying random outcome gaming event. One major security and trust problem with wagering is assuring that wagers, especially high value side bets bonus wagers and progressive jackpot wagers are accurate in amounts and derivation (which players). One typical attempt at players cheating is illegally modifying these high value wagers. Typically, when a winning event seems more likely, players have attempted to increase wagers, an act called late-betting.

Wagers have typically been provided in these high value events by placing chips on a table, making an electronic entry onto a funded side wager accounting function (e.g., the DEQ Platinum Plus® betting box), proximity detectors showing placement of a chip or token has been placed, or placement of tokens on a fixed location on a gaming table (as with Bet 'Em All™ craps games. These systems tend to be awkward and require constant oversight to avoid late-betting, or allow for only single value wagers (the proximity detectors), and have other shortcomings.

There are many technologies among the commercially available or disclosed systems. These include US Patent Application 20160218813 (Baerlocher) disclosing a gaming system includes game-logic circuitry performing a wagering streak game providing payouts in accordance with the ability for a player to accurately predict the outcome of another ancillary game. When the player accurately predicts the outcome of the ancillary game, an accuracy streak is formed that continues until the player fails to accurately predict an ancillary game outcome. Multiple players may simultaneously play streak games independently from one another, and a single player may simultaneously participate in multiple streak games dependent upon the same ancillary game. A player can begin, suspend, and resume a streak game at any time during selection of an upcoming outcome state for the ancillary game. Multiple players may also simultaneously participate in the streak game collectively, distinct from any participation in the ancillary game, by independently determining the accuracy streak using criteria common for all players (e.g., a common opponent or predefined condition).

US Patent Applications 20140038687 20160371933 (Nicely) 20160371933 (Nicely) evidences a gaming system including a plurality of symbols, a rotor and an award amount. The plurality of symbols include at least one secondary award group of the symbols. A wager is placeable on the secondary award group. The rotor displays the symbols and a plurality of ball landings adjacent to the symbols. A plurality of the symbols are indicatable after multiple spins of the rotor. The game system is operable to provide a secondary award based on the indication of one or more symbols within the secondary award group. That application is a continuation of, and claims priority to and the benefit of, U.S. patent application Ser. No. 13/722,631, which was filed on Dec. 20, 2012, which is a continuation of, and claims priority to and the benefit of, U.S. patent application Ser. No. 13/542,122, which was filed on Jul. 5, 2012, and issued as U.S. Pat. No. 8,342,941 on Jan. 1, 2013, which is a continuation of, and claims priority to and the benefit of, U.S. patent application Ser. No. 11/609,173, which was filed on Dec. 11, 2006, and issued as U.S. Pat. No. 8,221,214 on Jul. 17, 2012, which claims priority to and the benefit of U.S. Provisional Patent Application No. 60/748,848, which was filed on Dec. 9, 2005, and is expired, the entire contents of each of which are incorporated herein by reference.

U.S. Pat. No. 5,718,431, issued Feb. 17, 1998, to Ornstein, discloses a streak side wager for roulette that a player wins when the player achieves a preselected number of consecutive wins on the same conventional roulette wager (e.g., odds, evens, red, black, split, box, specific number, etc.).

US Patent Application 20120034970 (Stephens) evidences embodiments relating to an optional side bet in a game of Craps. Certain embodiments discussed herein provide a Craps player with the possibility of winning a large pay-out based upon the number of rolls a shooter makes before a seven-out. Conventional wagers in Craps are dependent on what number the shooter rolls. Some embodiments of the present invention provide a new method of wagering a side bet that is dependent on how many times a shooter rolls before a seven-out occurs. It is disclosed that it would be desirable to have a table bet that can 1) function as a multi-round bet, 2) provide a more accurate indicator of the length of a streak in progress at a particular table, and 3) reward players when a shooter experiences a long roll without a seven-out. Such a table bet would increase the excitement experienced by players by providing an indication of progress toward a goal with each non-seven-out throw of the dice. Unlike the Fire Bet or other previous multi-round bets, a table bet that provides information about the true length of the current streak would not require the shooter to make points to increase the streak counter, nor would it generate the anti-climactic moments inherent in the Fire Bet that are experienced when a shooter makes a redundant point, or throws some other combination that is irrelevant to the multi-round bet. A system for recording such wagers and progression in events is also disclosed for what is termed a Mega Bet Roll.

US Patent Application 20080254881 (Lutnick) evidences various embodiments in which a player may participate in gaming related activities using a terminal with multiple display screens.

US Patent Application 20040116179 (Nicely) discloses techniques for providing a streak game. A streak wager on a streak game is received and a representation of the streak wager is displayed. The streak game is made up of a number of consecutive main games and a selected outcome for each main game. An outcome of a main game is received. Whether the received outcome is the same as the selected outcome for the main game associated with the streak game is determined. The number of received consecutive outcomes that are the same as the selected outcomes for the main game associated with the streak game is tracked. If more than one streak game is in play at the same time, the streak games are each individually tracked. A new streak wager can be placed at any time, such that one streak wager need not be completed before a new streak wager is received.

US Patent Application 20040173866 (Stasi) discloses a proposition bet for Craps referred to as a FIRE BET™. The method includes predetermining a schedule of a pay-out table, players placing FIRE BET wagers at respective player betting areas prior to a shooter's initial come out; accumulating points responsive to outcomes of the shooter's dice throws, wherein points are made when a number 4, 5, 6, 8, 9 or 10 is twice rolled before sevening out, and wherein repeating of any made number is ignored, and making a pay-out based upon the points accumulated and the schedule.

US Patent Application 20180365926 (Pececnik) provides a table surface enables play of craps or roulette. A processor receives event outcomes from outcomes on the gaming table surface from game play. Multiple player input terminals are distributed around the gaming table surface in an arc including of more than 200 degrees. The multiple player input terminals are in two-way communication with the processor. An elevated display system is supported above and around the gaming table surface. The elevated display system shows a dynamic rendition of craps or roulette game play including at least a display of event outcomes from play of craps or roulette on which the wagers are resolved by the processor.

US Patent Applications 20040116177 and 20020090988 (Frost) evidences a gaming table in which the outcome of the game is determined manually, and in which players place bets electronically and wins or losses are calculated electronically. The gaming system is applicable to any suitable game including roulette. The technology also includes a "display tree", which is used to display the outcome of the game. Optionally, the display tree may also display the outcome of any number of the preceding games.

SUMMARY OF THE INVENTION

A physical system is used for reception of markers identifying placement of wagers on a series of sequential random outcomes. The physical system includes a series of distinct adjacent areas for receiving markers indicating wagers on the series of sequential random outcomes. Each distinct area has a surface area sufficient to accommodate a marker indicating wagers from a single player of between 2.5 and 5.5 cm in diameter within borders of each distinct area. There is associated with each area an indicator of a degree of progression through a sequence of random outcomes. The indicator provides an indication of a degree of progression changing after each sequential outcome. Any markers present on a distinct area moving relative to a last indicator (either the marker moving or the indicator moving) on which any marker was present to indicate a change in a degree of progression in the series of sequential random outcomes.

DETAILS OF THE INVENTION

Figure 1:
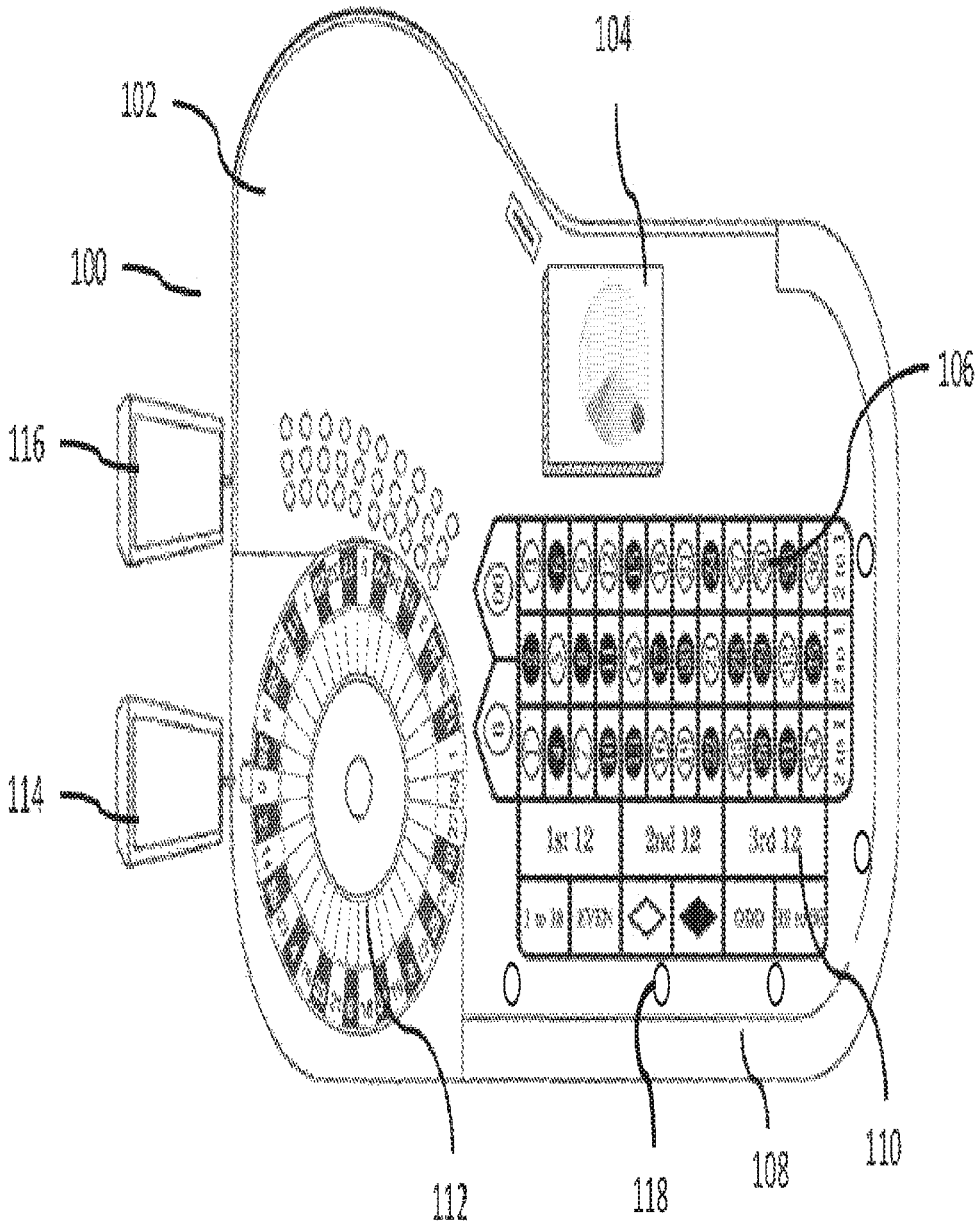
FIG. 1 is a top view of a roulette gaming table having the electronic streak recorder of the present technology.

A physical system on or adjacent to a surface of a gaming table for reception of markers identifying placement of wagers on a series of sequential random outcomes. The physical system has a series of distinct adjacent areas for receiving markers indicating wagers on the series of sequential random outcomes. Each distinct area has a surface area sufficient to accommodate a marker indicating wagers from a single player of between 2.5 and 5.5 cm in diameter within borders of each distinct area. The areas may be numbered, lettered, colored, graphically depicted via video surface or projection, have variable lighting effects on them or associated with each of them. There is associated with each area is an indicator of a degree of progression through a sequence of random outcomes. The sequence of random outcomes are provided in an underlying gaming event which may include any of standard gaming objects and elements used in casinos, such as but not excluding others or roulette games, candy wheel games (e.g., Big 6 games), dice games (e.g., craps or Sic Bo, or Yahtzee), playing card games (e.g., blackjack, baccarat, poker and poker variants), tile games (e.g., Pai Gow Tiles), electronic event table games (as either equivalents of the earlier mentioned games or unique random event outcome games) and the like.

The indicators are to evidence and memorialize (at least for a short term of fewer than 100 random event outcomes) a degree of progression changing after each sequential outcome. By degree of progression it is meant a list, range, sequence, history and the like of random events and outcomes in the underlying game. When wagers are placed, there may or may not have been a previous one of more events, with the sequence starting anew, or starting anew after existence of a running sequence. For example, in a roulette game, sequences may be of consecutive colors, consecutive numbers, consecutive sectors (e.g., lines, rows, columns, odd or even, high or low, sections of twelve numbers, or any other identifiable results that can be identified in a sequence or series). In a dice event, there can be consecutive numbers, sequences of winning outcomes, collections of available numbers, odd and even, number battles (such as "6 versus 8", tracking consecutive 8s rolled before a 6, or consecutive 6s rolled before an 8,) combinations of 1-1, 1-2, 6-5 and/or 6-6, combinations of hard ways or doubles, rolls of sevens, rolls without a seven, etc. In card games it can be sequences of dealer wins, sequences of player wins, sequences of significant value or ranks of hand, sequences of similarly colored or suited hands, or identification of any clear result or event. For example, wagers may be made in blackjack on streaks of consecutive color of dealer's up-card (red/black), consecutive blackjacks, consecutive dealer busts, consecutive hands of 21, consecutive hands of 20 or more (without nesting), consecutive hands of 19 or more (without nesting), by either players or dealers. Similarly in baccarat, consecutive hand counts if a) combined totals of 18, combined totals of 17 or more, combined totals of 16 or more, consecutive player hand wins, consecutive banker hand wins, consecutive ties, and the like. In card games where the dealer's hand involves "qualifying," (such as variants of 3 Card Poker, Ultimate Texas Hold 'Em™ poker, Caribbean Stud™ Poker, High Card Flush, etc.) streaks of whether the dealer's hand qualifies or not qualifies, as well as the color of any dealer's up-card could be tracked for such streak wagers. In poker games, consecutive player (or dealer) hands in excess of three-of-a-kind (or at least higher hands such as straights or flushes) can be used as individually measured hands to form an element of the wagered upon sequence.

Any markers present on a distinct area moving relative to a last indicator on which any marker was present to indicate a change in a degree of progression in the series of sequential random outcomes. By "movement" it is meant the indication of the indications, the indicators, a relative physical position, adjacent wager areas for the markers, the relative colors are translated along a sequence to indicate an alteration (advancement) of a wager in the sequence. For example, in a linear display of twenty consecutive areas, there may be in or adjacent to the placed area of the marker indicating a particular player's wagering on a sequence. For example, a wager is placed on the tenth sequence before any specific random event is determined for a wagering sequence. Upon one event (e.g., for purposes of example only) being a "red" outcome, the distinct area adjacent the placement of the wager is altered (e.g., by being lit red, having color of a particular wavelength added) and the like. At this point, a new wager can be placed on the most recently lit or colored area, starting a new sequence. No wagers may be placed on the original position where the wagers were started. A next random event is then performed, and, depending upon its outcome, the lighting will again advance. For example, if a second "red" outcome occurs, the light effect indicating a second red event in sequence. Again, additional wagers can be placed, this time on only the second lit indicator. If the second outcome had been "black" or "green," then the original outcome with a positive advancing "red" outcome would be voided, and the marker on that wagered outcome would be removed. If the second wager placed was inclusive of "black" or "green," then the advance from the second wager position may be forward or backward along the twenty-position track. The underlying wager may be on any same color sequence, a specific color sequence, and others previously mentioned. If the event is color sequences, the payout can be varied according to either red or black sequences and green (0 and 00) sequences, with higher payouts for the last.

A more preferred embodiment is a pie-shaped display area. This may be a circular shape (with a display screen with controls over each slice area in the display). By "circular" is meant any geometric shape that can include slices, such as ovals, ten-point diamond shapes, octahedrons and the like. The shape is of less consequence as long as there are adjacent slices. The "circle" may be solid, with slices all the way to the center, or have a track around a central area. A wager can be placed on a starting slice, and the events proceed. As the slices are continuous, the indications of the events (by colors, numbers, colors and numbers, light intensity and the like) may proceed smoothly within the circle smoothly and consecutively. There would likely be a single direction (rotational) of movement of the indicators. The indicators may be within the circle or circumscribe the wagering/marker areas within the circle. The sequence of events in identifying outcomes, ends of sequences or starting sequences would be registered as described above and in greater detail later.

The physical system may have distinct adjacent areas that are provided in a physical orientation selected from the group consisting of linear arrays of distinct areas or pie-shaped segments of a circular area. The physical system may have the circular area constructed as an electronic display surface having a display area with the pie-shaped segments displayed on the electronic display surface. After any sequential random outcome, either a color, lighting or symbol change occurs within or adjacent to each pie-shaped segment. The physical system may have the electronic display surface configured to respond to input of any sequential random outcome by changing color or light intensity to indicate the degree of progression in the series of sequential random outcomes. The physical system may be positioned on or adjacent to a roulette table, and wherein random outcomes from roulette events are fed as signals to the electronic display so that either a color, lighting or symbol change occurs within or adjacent to each pie-shaped segment. The system may be lain on the surface, embedded in the surface, attached adjacent to the surface or be spaced (preferably flush) by the surface. As noted, random outcomes are preferably selected on a roulette table from the group consisting of indications or a red outcome, a black outcome and a green outcome in roulette.

The physical system may likewise be positioned on or adjacent to a craps table, and wherein random outcomes from dice casting events are fed as signals to the electronic display so that either a color, lighting or symbol change occurs within or adjacent to each pie-shaped segment.

A method of maintaining a tally of random events on a physical system on a surface of a gaming table for reception of markers identifying placement of wagers on a series of sequential random outcomes including:

- a series of distinct adjacent areas for receiving markers indicating wagers on the series of sequential random outcomes;
- each distinct area having a surface area sufficient to accommodate a marker indicating wagers from a single player of between 2.5 and 5.5 cm in diameter within borders of each distinct area;
- associated with each area is an indicator of a degree of progression through a sequence of random outcomes;
- the indicator of a degree of progression changing after each sequential outcome; and
- any markers present on a distinct area moving relative to a last indicator on which any marker was present to indicate a change in a degree of progression in the series of sequential random outcomes.

The method includes at least one player having a marker indicative of that player placed on a first distinct area;

executing an underlying game on the gaming table and determining a specific random outcome;

inputting the specific outcome to at least one indicator associated with a respective distinct area; and altering indications of the degree of progression changing in the series of sequential random outcomes by altering color differences, altering lighting differences of physically moving of a marker or indicator relative to a last indicator on which any marker was present to indicate a change in a degree of progression in the series of sequential random outcomes.

EXAMPLE

A completely formatted system may be provided that enables the following process. Not all steps are required, and not all components are required, as this example includes optional components, variations in components and optional steps. A casino table roulette layout will be used as an example, with a circular progression of events display used, with eight pie-slice, full-color LED display segments available for wager placement and event result identification. Each player wishing to place a streak wager (in this case on sequential color outcomes of only red, only black or only green) place wagers (one or more roulette chips or casino chips, which also identify the individual player) on player dedicated (at each player position) or in individual wager dedicated (a communal betting position). A croupier collects all markers/chips/tokens placed on the table for the wager.

The markers are all placed (may be in a single stack) on a single pie-slice area of the progressive event display by the croupier. The LED display preferably has a marker reader (camera, video capture, RFID reader, or the like) which reads the number of markers and the identification on each marker associated with a unique player or player position at the gaming table. A separate running tally/history board can display the information on number and identity of players, number of markers (value of wager) for each player, and the status of each wager as the gaming event progresses. Before the completion of a first event after placement of these wagers, players can confirm the status of their individual wagers. As roulette tables ordinarily use single value chips of a single specific color for each player/player position, the displayed image of status can show each a number of chips, with each chip shown as the color of the chip for each unique player.

Before a first event in the underlying roulette game is begun, the players may check the status of this progressive event or sequential event wager on the tote screen. The screen may also specifically identify the status of awards on that wager, the first wager/status report always being an equivalent of "wager on the next event," with no reward indicated. The croupier betting placement panel may be directly linked to the tote board so that information input to the betting placement panel (the pie-slice display) is fed directly into the tote board. The information on the betting placement panel may be automatically read (as indicated for the chips) and supplemented by automatic or manual input (by only the croupier) of each random outcome event.

A first roulette event outcome is created by ball drop and capture steps standard in the execution of a roulette gaming event. The outcome, for purposes of the sequenced event wager, is determined only as red, black or green. This information is transmitted to the betting placement panel by automated read of the event and hardwired or wireless transmission to the panel or by croupier manual entry on buttons or touchscreen on or associated with the touchscreen. Croupiers may even have a hand-held personal data entry element (like a smart phone) that can transmit this information to the betting placement panel. When this information is input and received by the betting placement panel, the pie-slice previously indicating information of the intent to place a wager (e.g., "next wager placement") changes it "information" by (for example) removing text from that slice, changing its color, changing its text to state "1$^{st}$ outcome" or the like. The information displayed on the tote board similarly changes.

For example, if the original display was three different players each wagering two (same value) chips, that would have been displayed on a first (e.g., top) line of the tote screen. Upon entry of the first random event outcome data to the betting placement panel, the display on the tote board may change by the original "line" of wagers dropping to a lower line identified as "first outcome" or "red" or "black" or "green" or the like. The first line will then open up, allowing new wagers (if any) to be displayed there. There may be no award available on the first outcome 9 except for possibly green outcomes).

After any subsequent wagers on the "next event" position (so that a player or players may have multiple running wagers at any given time), the roulette underlying random game event is performed, and the same physical and electronic effects are replicated. If two wagers by the same or different players were placed, the tote screen would have an image of a first (top) line with those two wagers indicated and the second (first event) line below it showing the three previous wagers. After a second "positive" event, the two previous lines would "drop" lower on the tote board now showing an empty "next event" top line, a first outcome second line with the two wagers, and a third line indicating second outcome of a continuing wager with the three initial wagers of this example.

Ads part of this process, the outcomes are automatically or manually input to the betting placement panel by the croupier, and chips may be physically placed on the appropriate pie-slices by the croupier. If the communal wager collection area or each of the individual player positions can be accurately read with respect to the amount of wagers and source (player) of wagers, the chips may be virtually placed on the betting placement panel, although physical placement is highly desirable.

A review of the Figures will further assist in the appreciation of the operation and structures of the present invention. All identical numbers in the Figures describe identical or substantially similar elements in the Figures.

FIG. 1 is a top view of a roulette gaming table 100 having the electronic streak recorder 104 of the present technology. On the gaming table 100 is a croupier work surface 102, the electronic streak indicator 104 (which alternatively may be the conveyor format described above), the standard wager placement surface 106 for individual numbers, segments 110 (and other wagers). There is a cushion 108, the standard roulette wheel 112 for the ball (not shown) drop. A tree 114 may show outcome histories, and a second screen 116 will show wager results from the outcomes displayed on the electronic (or conveyor) streak indicator 104. The gaming table includes a dedicated space 118 for wager placement to be subsequently placed on the electronic streak indicator.

Figure 4A:
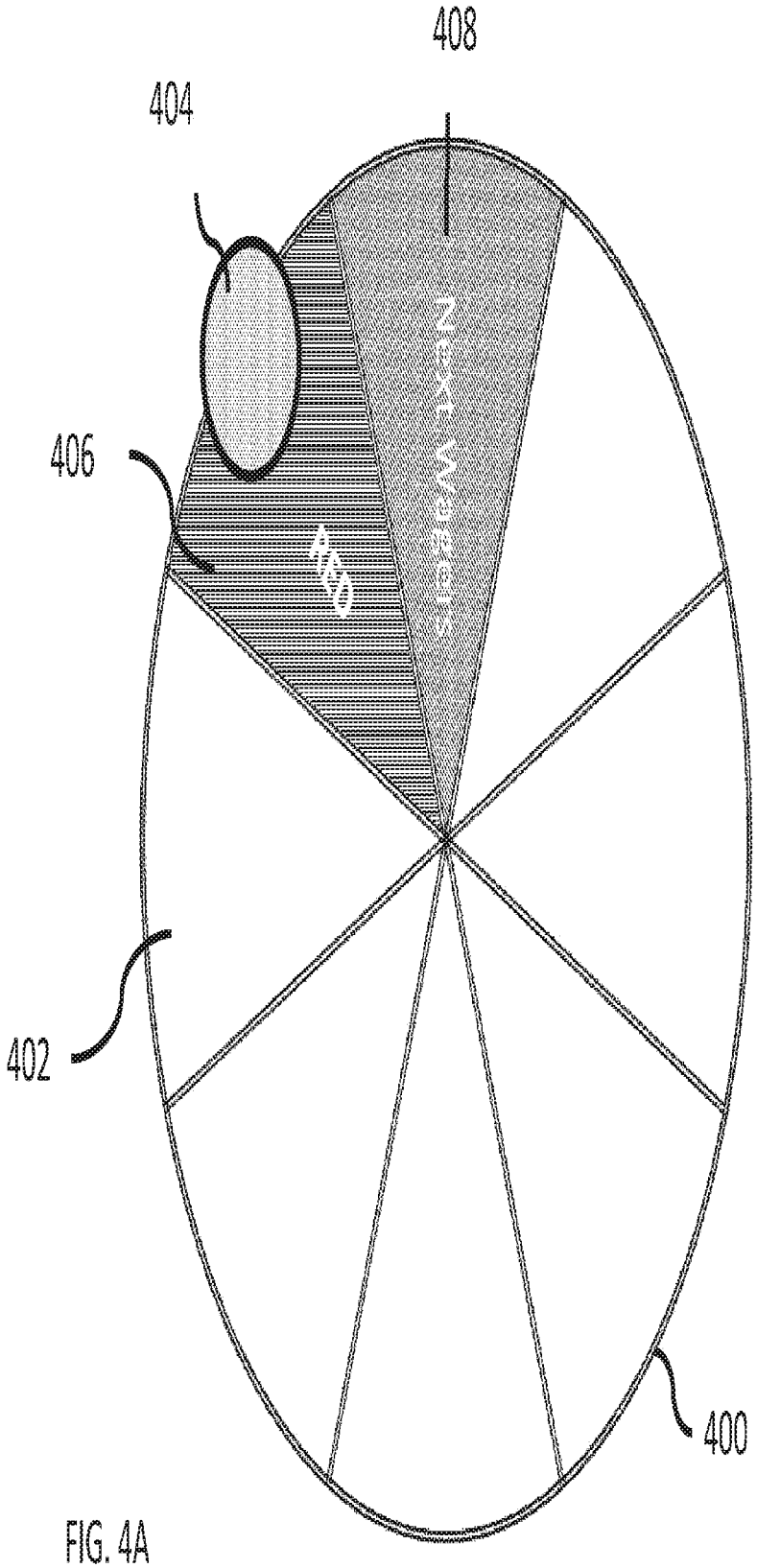
FIG. 4A is a full view the electronic streak recorder of the present technology with a first wager and first result displayed.

FIG. 4A is a full view the electronic streak recorder 400 of the present technology with a first wager 404 and first result 406 displayed. Also shown are available segments 402 to indicate outcomes, and a single segment 408 to indicate where placement of chips/tokens/markers shall be made for next wagers.

Figure 4B:
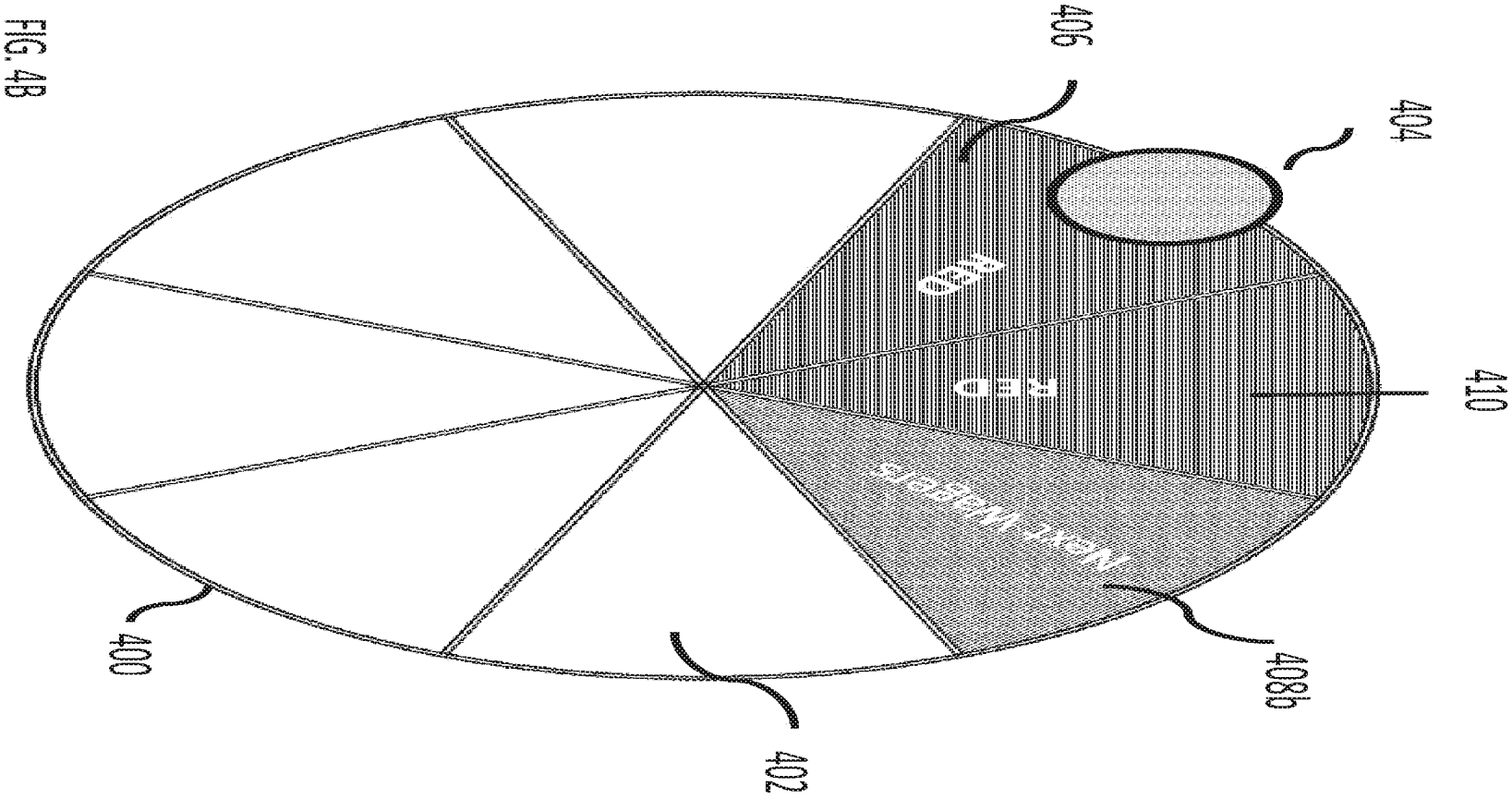
FIG. 4B is a full view the electronic streak recorder of the present technology with a first wager and first and second results displayed.

FIG. 4B is a full view the electronic streak recorder 400 of the present technology with a first wager 404 and first 406 and second 410 results displayed, and a single segment 408*b* to indicate where placement of chips/tokens/markers shall be made for next wagers.

Figure 4C:
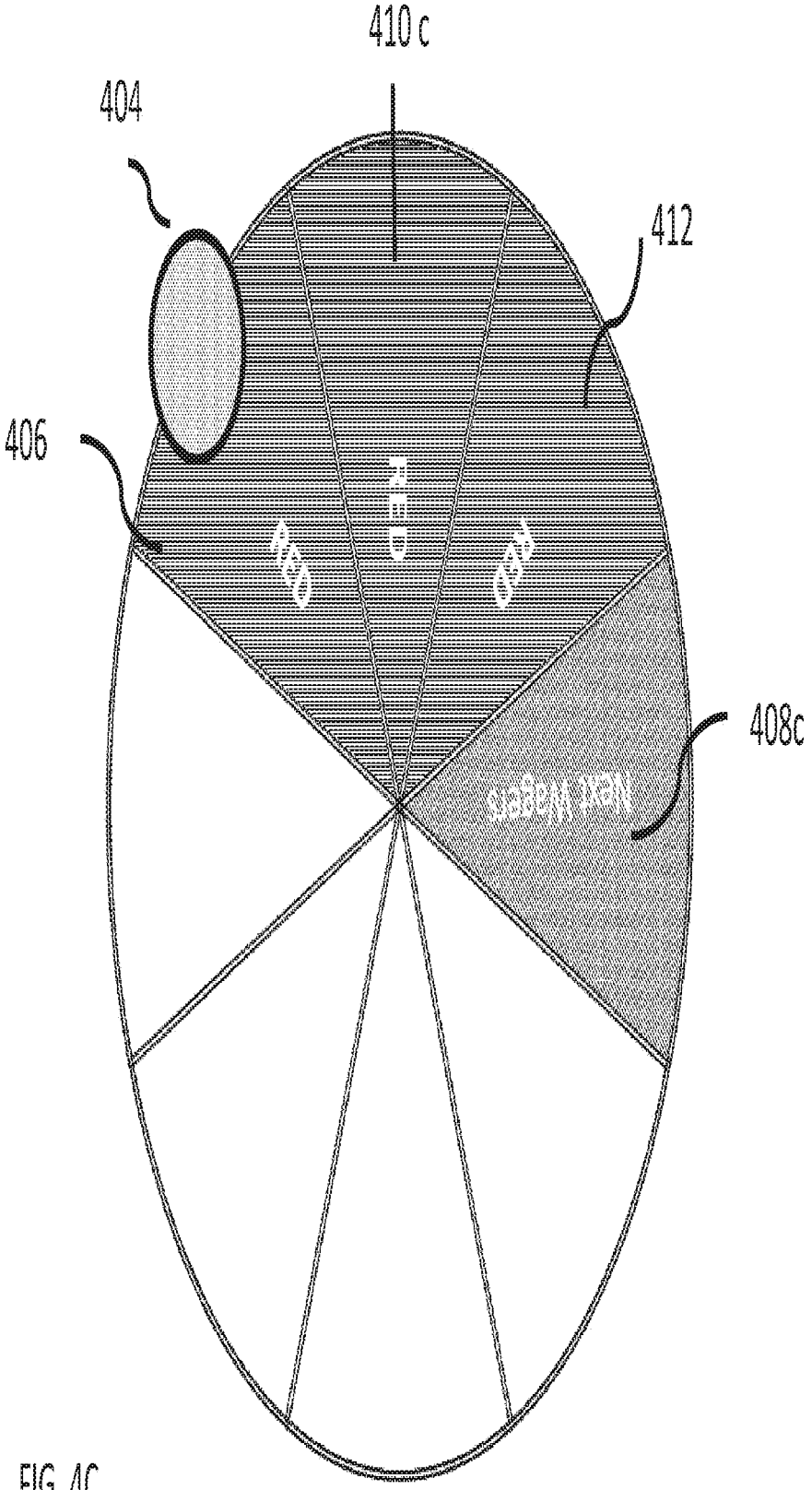
FIG. 4C is a full view the electronic streak recorder of the present technology with a first wager and first and second and third results displayed.

FIG. 4C is a full view the electronic streak recorder of the present technology with a first wager 404 and first 406 and second 410*c* and third 412 results displayed. There is again a single segment 408*c* to indicate where placement of chips/tokens/markers shall be made for next wagers.

Figure 5A:
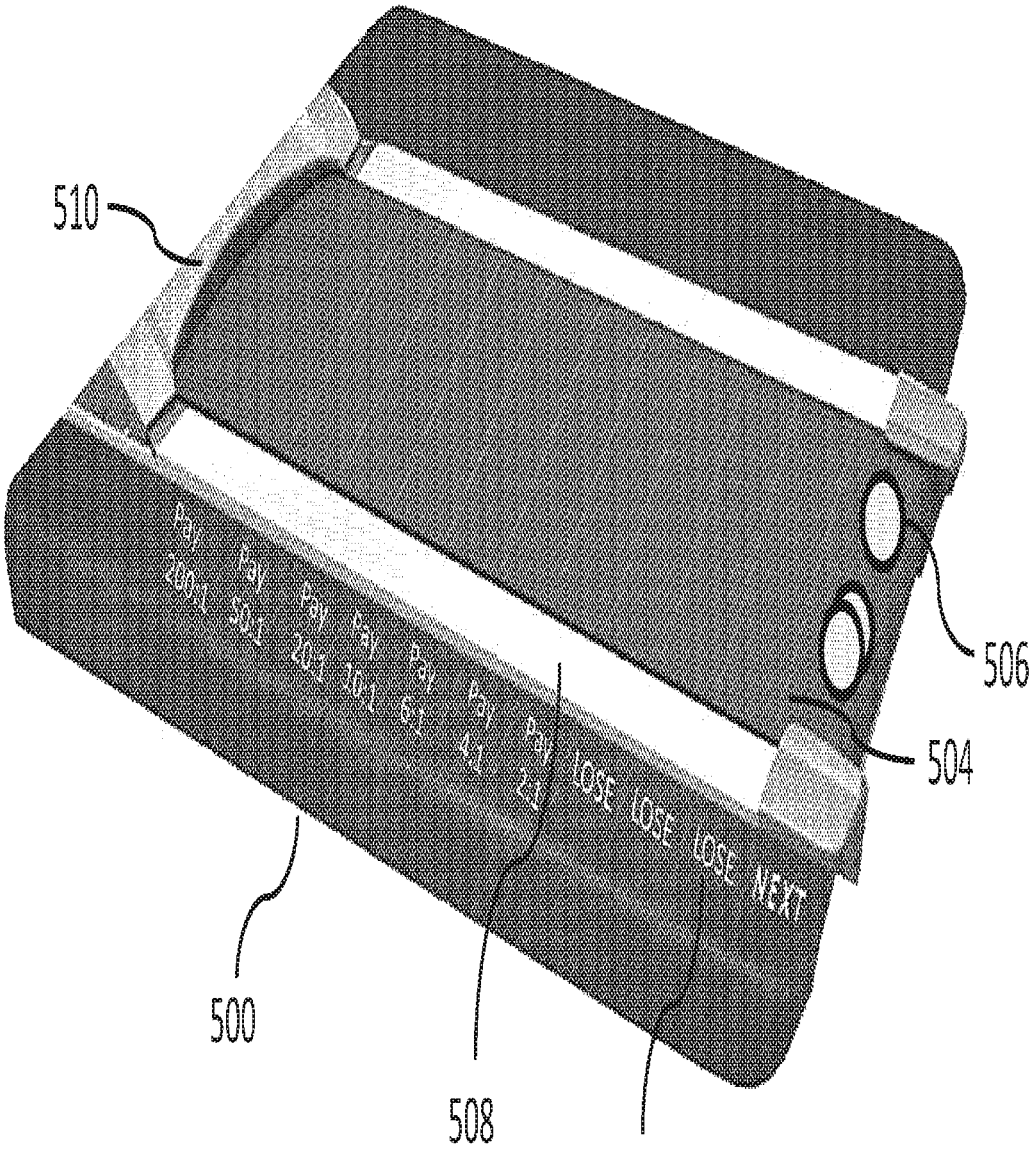
FIG. 5A is a perspective view of a conveyor belt system for an electronic streak recorder of the present technology with multiple first wagers placed.

FIG. 5A is a perspective view of a conveyor belt system 500 for an electronic streak recorder of the present technology with multiple first wagers 506 placed on conveyor segments 504. Guide ribs 508 and an end catch 510 re shown.

Figure 5B:
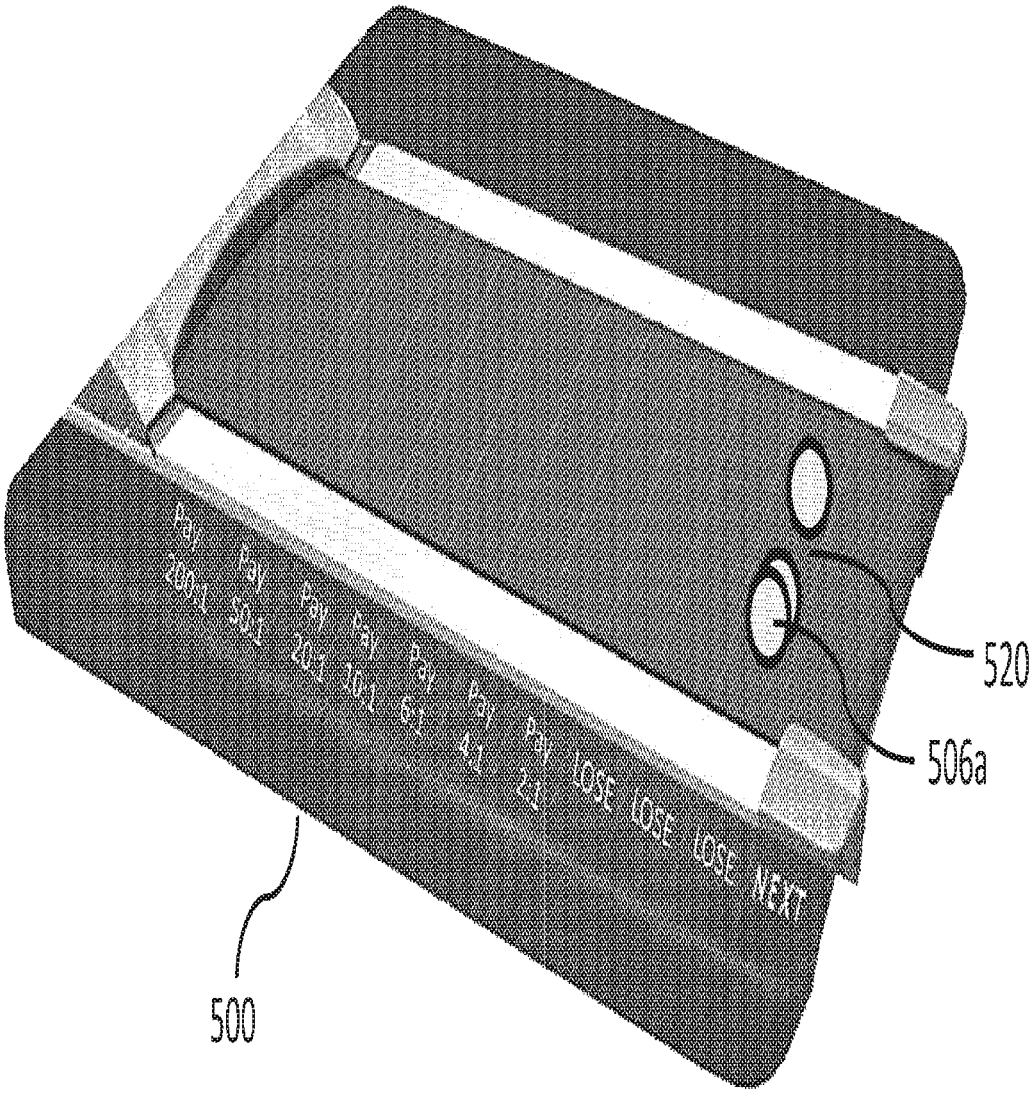
FIG. 5B is a perspective view of a conveyor belt system for an electronic streak recorder of the present technology with multiple first wagers placed and a first result indicated.

FIG. 5B is a perspective view of a conveyor belt system 500 for an electronic streak recorder of the present technology with multiple first wagers 506*a* placed and a first result indicated 520.

Figure 5C:
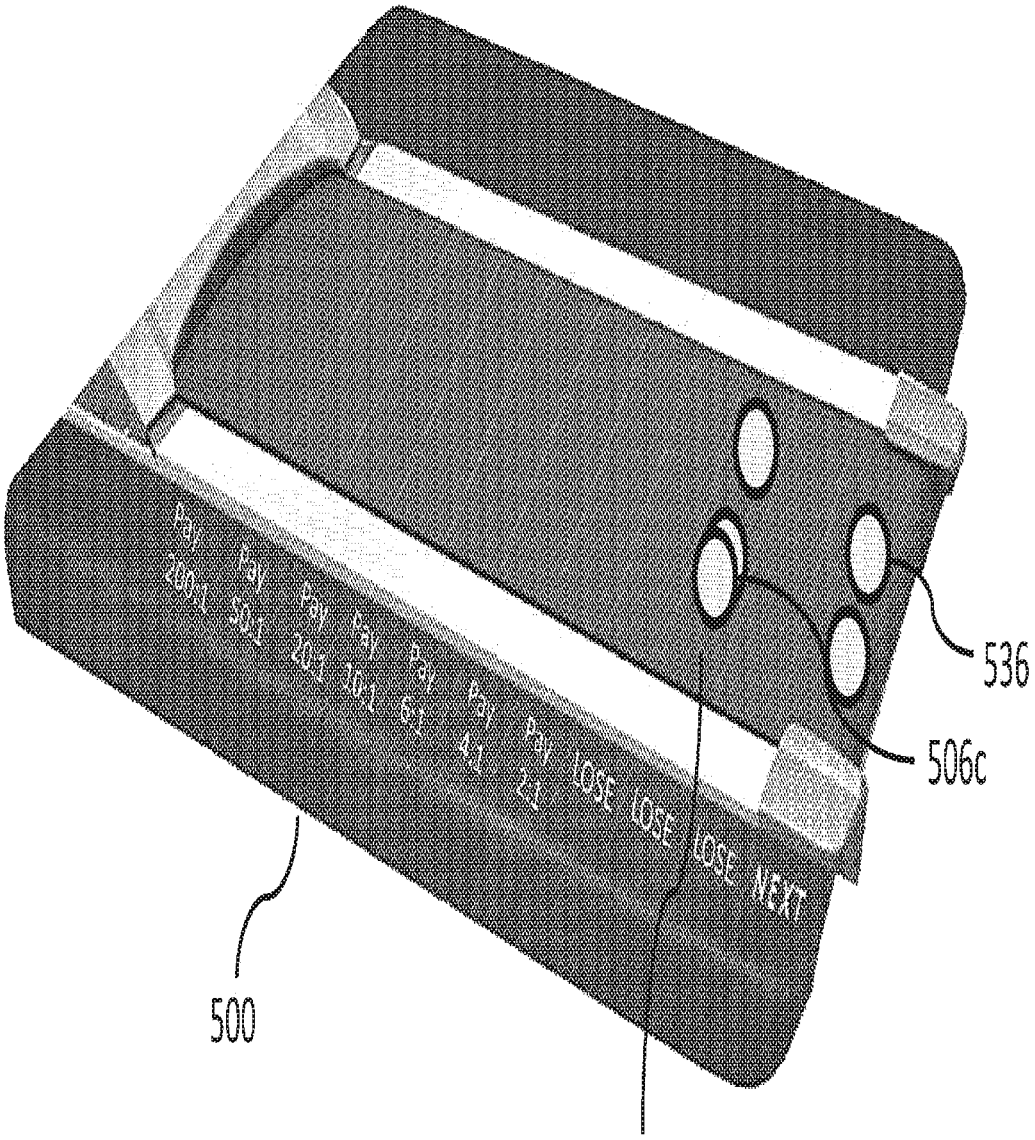
FIG. 5C is a perspective view of a conveyor belt system for an electronic streak recorder of the present technology with three multiple first wagers placed, two next wagers placed and a second result indicated.

FIG. 5C is a perspective view of a conveyor belt system 500 for an electronic streak recorder of the present technology with three multiple first wagers 506*c* placed, two next wagers 536 placed and a second result 530 indicated.

Figure 5D:
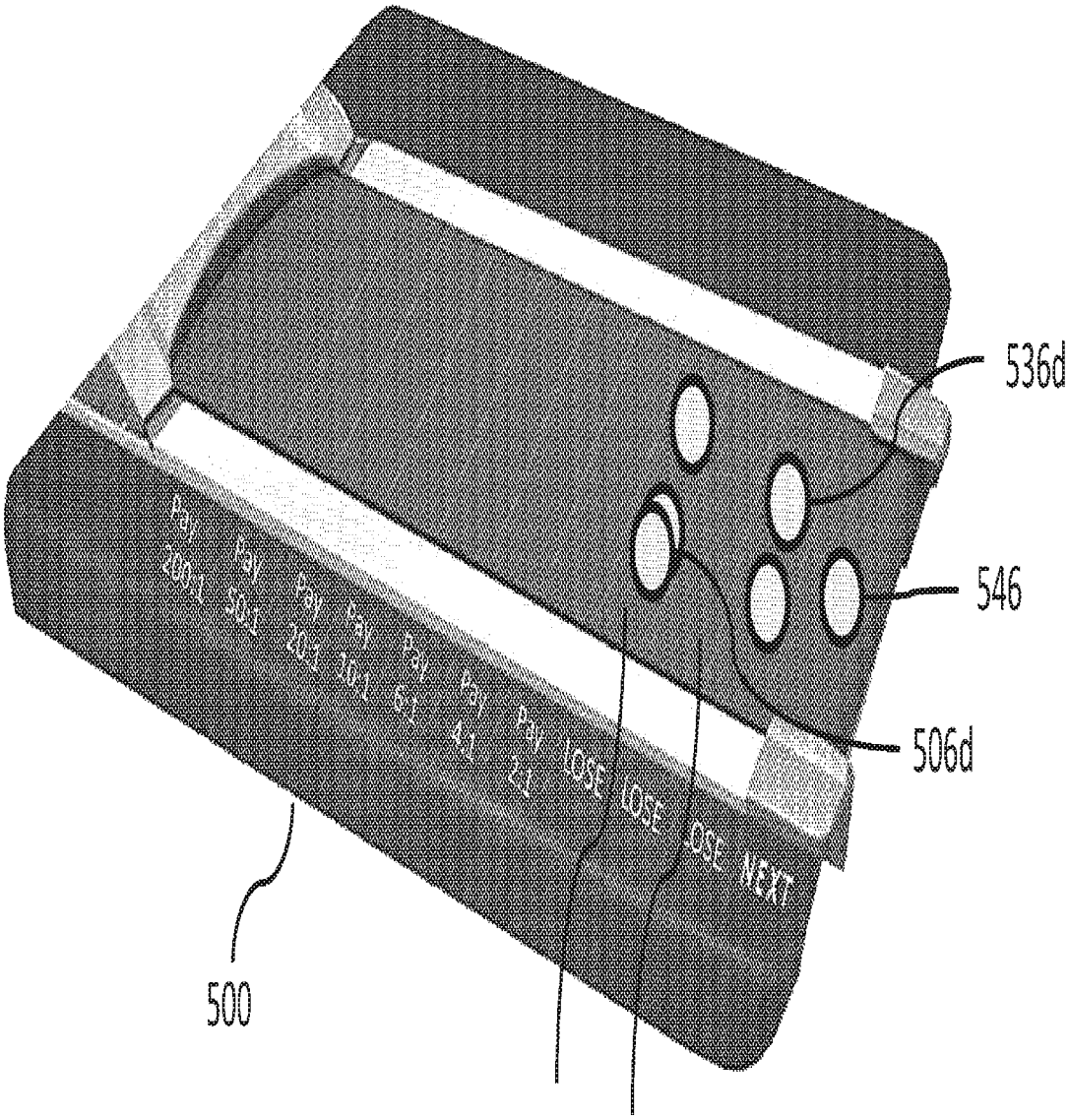
FIG. 5D is a perspective view of a conveyor belt system for an electronic streak recorder of the present technology with three multiple first wagers placed, two next wagers placed, a single next wager placed and a third result indicated.

FIG. 5D is a perspective view of a conveyor belt system for an electronic streak recorder 500 of the present technology with three multiple first wagers 506*d* placed, two next wagers placed 536*d*, a single next wager placed 546 and a third result indicated 540. An empty wagering space 542 along the conveyor is also shown.

Figure 5E:
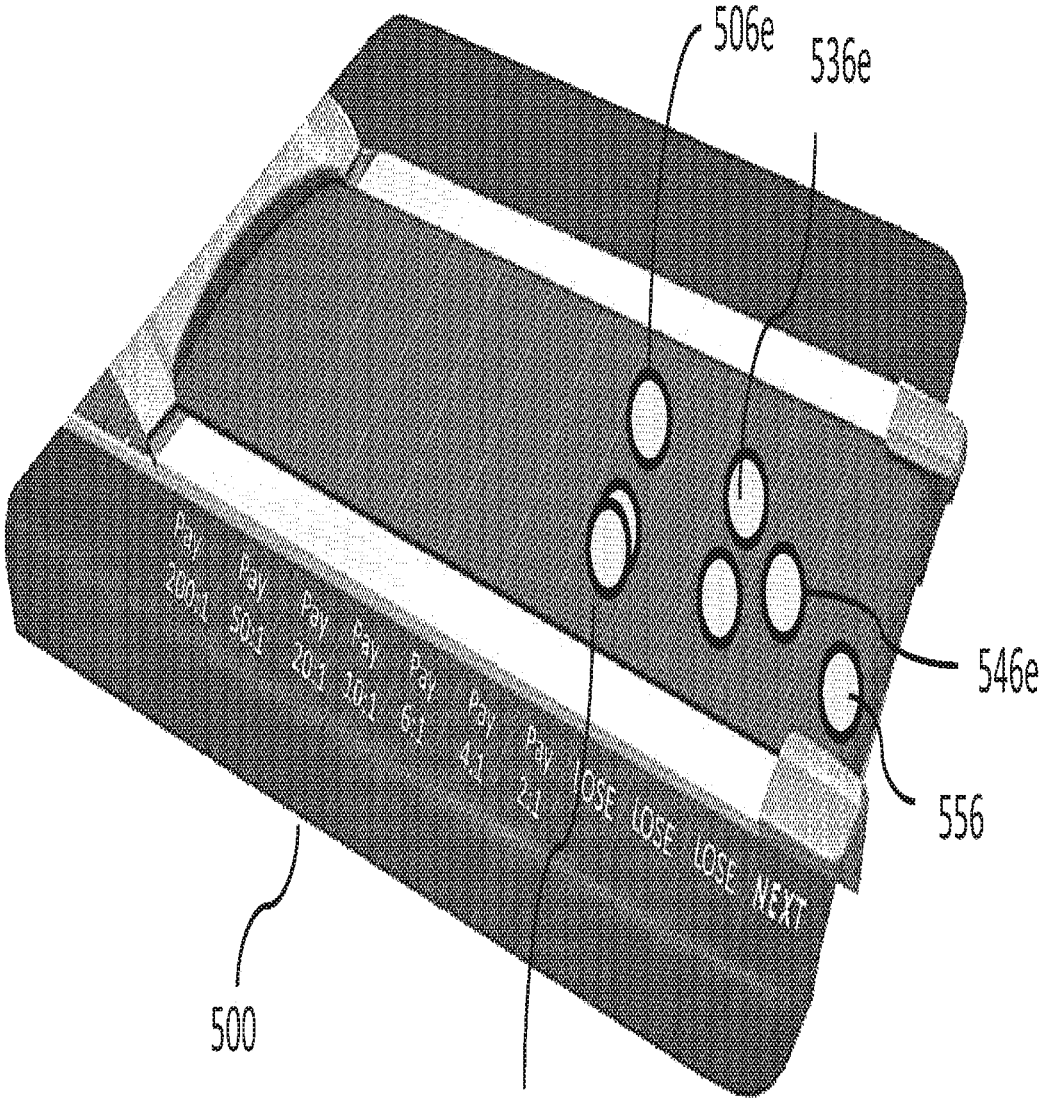
FIG. 5E is a perspective view of a conveyor belt system for an electronic streak recorder of the present technology with three multiple first wagers placed, two next wagers placed, a single next wager, a second single next wager placed and a fourth result indicated.

FIG. 5E is a perspective view of a conveyor belt system 500 for an electronic streak recorder of the present technology with three multiple first wagers 506*e* placed, two next wagers placed 536*e*, a single next wager 546*e*, a second single next wager 556 placed and a fourth result 550 indicated at a Pay 2:1 position.

A method of maintaining a tally of random events on a physical system on a surface of a gaming table for reception of markers identifying placement of wagers on a series of sequential random outcomes could include:

- a series of distinct adjacent areas for receiving markers indicating wagers on the series of sequential random outcomes;
- each distinct area having a surface area sufficient to accommodate a marker indicating wagers from a single player of between 2.5 and 5.5 cm in diameter within borders of each distinct area;
- associated with each area is an indicator of a degree of progression through a sequence of random outcomes;
- the indicator of a degree of progression changing after each sequential outcome; and
- any markers present on a distinct area moving relative to a last indicator on which any marker was present to indicate a change in a degree of progression in the series of sequential random outcomes;

the method comprising at least one player having a marker indicative of that player placed on a first distinct area;

executing an underlying game on the gaming table and determining a specific random outcome;

inputting the specific outcome to at least one indicator associated with a respective distinct area; and altering indications of the degree of progression changing in the series of sequential random outcomes by altering color differences, altering lighting differences of physically moving of a marker or indicator relative to a last indicator on which any marker was present to indicate a change in a degree of progression in the series of sequential random outcomes.

The series of distinct adjacent areas for receiving markers indicating wagers on the series of sequential random outcomes may be provided on an electronic display panel (as described above) where markers remain in a fixed position and panels of light within the electronic display panel are altered to indicate gaming outcomes and positions for available wagering. In the conveyer system, the award markings and indicators remain fixed while the markers are moved.

The method is preferably practiced where the underlying game is roulette, and a physical ball is dropped into a spinning roulette wheel to determine random outcomes indicated on the electronic display panel. Craps, poker, blackjack, baccarat, big six wheels and the like may also be used.

The displayed results comprise roulette outcomes may be selected from the group consisting of red outcomes, green outcomes and black outcomes, or they may include roulette outcomes selected from the group consisting of odd outcomes, even outcomes, and green outcomes are distinguished from both even and odd outcomes. The amounts of payouts on existing individual wagers may be displayed on the electronic display panel for a croupier to read, and/or amounts of payouts and a status of all wagers in a streak event are displayed on an upright display panel for both a player and a croupier to read.

Figure 2:
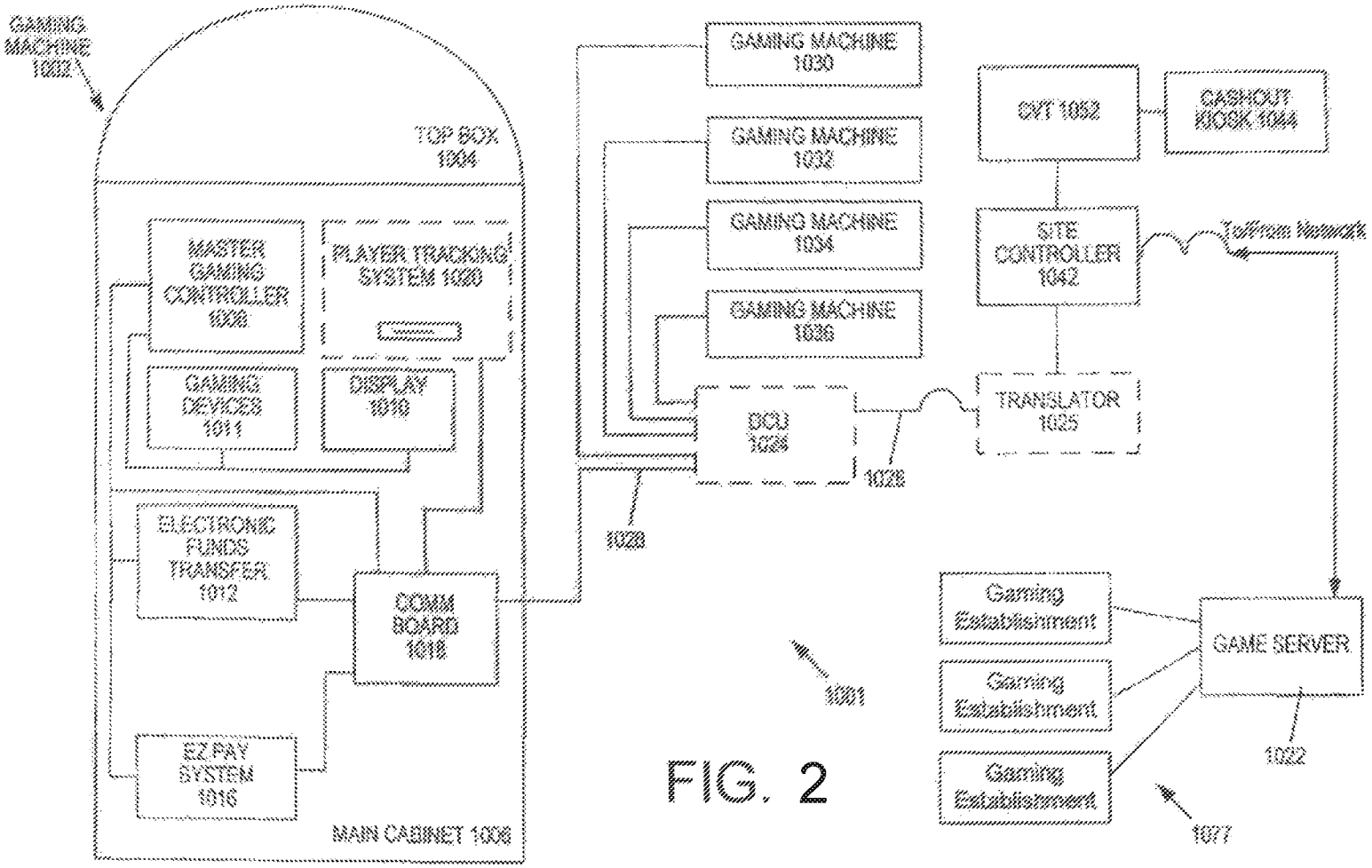
FIG. 2 shows a schematic for an electronic system for enabling play of the gaming method described herein.

It will be appreciated by those of skill in the art that embodiments of the present invention could be implemented on a network with more or fewer elements than are depicted in FIG. 2. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 3:
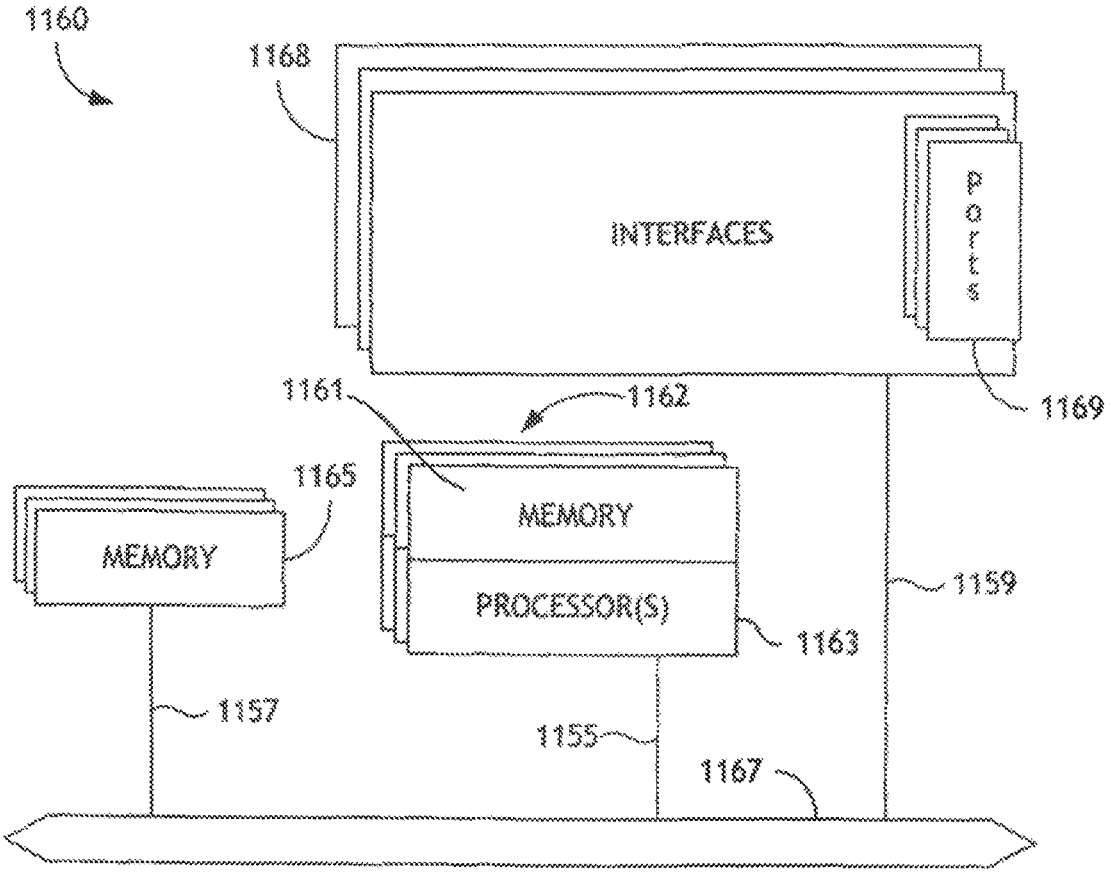
FIG. 3 shows another schematic for an electronic system for enabling play of the gaming method described herein.

FIG. 3 illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention also relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 3 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 3) or switch fabric based (such as a crossbar).

Other alternative practices may be used by one skilled in the art within the scope of the present invention, such as automated roulette and crap systems, on-line roulette and crap systems, and the like.

What is claimed:

1. A physical system for use on a surface of a gaming table for managing wagers on a series of sequential random outcomes, the system comprising:

a streak indicator for displaying a series of distinct adjacent areas to place thereon representations of wagers, the streak indicator comprising:

a wager representation reader configured to identify a number of representations of wagers placed on a distinct adjacent area;

an interface configured to receive computer signals representing sequential random outcomes of the series of sequential random outcomes; and at least one processor configured to automatically visibly change at least one distinct adjacent area in response to the interface receiving the computer signals to indicate a degree of progression through the series of sequential random outcomes;

the distinct adjacent areas comprising:

a starting area to place thereon representations of initial wagers, the processor configured to automatically visibly change the starting area in response to the interface receiving a computer signal representing an initial random outcome of the series of sequential random outcomes to indicate completion of the initial random outcome and that no new representations of wagers can be accepted for the initial random outcome; and an additional area adjacent to the starting area to place thereon representations of additional wagers, the processor configured to automatically visibly change the additional area in response to the interface receiving the computer signal representing the initial random outcome to indicate the representations of additional wagers can be accepted, the processor further configured to automatically visibly change the additional distinct adjacent area in response to the interface receiving a computer signal representing an additional random outcome of the series of sequential random outcomes to indicate completion of the additional random outcome and that no new representations of wagers can be accepted for the additional random outcome.

2. The physical system of claim 1 wherein the distinct adjacent areas are oriented as one of linear arrays of distinct areas and pie-shaped segments of a circular area.

3. The physical system of claim 1 wherein the streak indicator comprises an electronic display surface comprising a display area for displaying the distinct adjacent areas.

4. The physical system of claim 3 wherein the visible change in response to a random outcome comprises at least one of a color, lighting intensity, and symbol change on at least one of the distinct adjacent areas.

5. The physical system of claim 3 wherein the processor is further configured to change a color of the electronic display surface upon reception of a computer signal representing a random outcome.

6. The physical system of claim 3 wherein the electronic display surface further comprises an electronic display area for displaying amounts of payouts for existing wagers.

7. The physical system of claim 1 wherein the series of sequential random outcomes comprises one of roulette events, die casting events, and card-based events.

8. The physical system of claim 1 wherein the wager representation reader comprises one of a camera, a video capture, and a radio frequency identification (RFID) reader.

9. A method for managing wagers on a series of sequential random outcomes using a physical system on a surface of a gaming table, the physical system including a streak indicator for displaying a series of distinct adjacent areas to place thereon representations of wagers, the streak indicator including a wager representation reader, an interface, and at least one processor, the method comprising:

identifying via the wager representation reader a number of representations of wagers placed on a distinct adjacent area;

receiving via the interface computer signals representing sequential random outcomes of the series of sequential random outcomes; and automatically visibly changing via the processor the streak indicator in response to the interface receiving the computer signals to indicate a degree of progression through the series of sequential random outcomes, the automatic visible changing of the streak indicator comprising:

automatically visibly changing a starting area of the distinct adjacent areas in response to the interface receiving a computer signal representing an initial random outcome of the series of sequential random outcomes to indicate completion of the initial random outcome and that no new representations of wagers can be accepted for the initial random outcome;

automatically visibly changing an additional area of the distinct adjacent areas adjacent to the starting area in response to the interface receiving the computer signal representing the initial random outcome to indicate representations of additional wagers can be accepted; and automatically visibly changing the additional area via the processor in response to the interface receiving a computer signal representing an additional random outcome of the series of sequential random outcomes to indicate completion of the additional random outcome and that no new representations of wagers can be accepted for the additional random outcome.

10. The method of claim 9 wherein the visible change in response to a random outcome comprises a color change.

11. The method of claim 9 further comprising visibly changing an electronic display surface of the streak indicator via the processor upon reception of a computer signal representing a random outcome.

12. The method of claim 9 further comprising displaying amounts of payouts for existing wagers on an electronic display surface upon reception of a signal representing a random outcome.

13. A physical system for use on a surface of a gaming table for managing wagers on a series of sequential random outcomes, the system comprising:

a streak indicator for displaying a series of distinct areas in sequence to place thereon representations of wagers, the streak indicator comprising:

a wager representation reader configured to identify a number of representations of wagers placed on a distinct adjacent area;

an interface configured to receive computer signals representing sequential random outcomes of the series of sequential random outcomes; and at least one processor configured to automatically visibly change at least one distinct area in response to the interface receiving the computer signals to indicate a degree of progression through the series of sequential random outcomes;

the distinct areas comprising:

a starting area to place thereon representations of initial wagers, the processor configured to automatically visibly change the starting area in response to the interface receiving a computer signal representing an initial random outcome of the series of sequential random outcomes to indicate completion of the initial random outcome and that no new representations of wagers can be accepted for the initial random outcome; and an additional area to place thereon representations of additional wagers, the processor configured to automatically visibly change the additional area in response to the interface receiving the computer signal representing the initial random outcome to indicate the representations of additional wagers can be accepted, the processor further configured to automatically visibly change the additional area in response to the interface receiving a computer signal representing an additional random outcome of the series of sequential random outcomes to indicate completion of the additional random outcome and that no new representations of wagers can be accepted for the additional random outcome.

14. The physical system of claim 13 wherein the distinct areas are oriented as one of linear arrays of distinct areas and pie-shaped segments of a circular area.

15. The physical system of claim 13 wherein the streak indicator comprises an electronic display surface comprising a display area for displaying the distinct areas.

16. The physical system of claim 15 wherein the visible change in response to a random outcome comprises at least one of a color, lighting intensity, and symbol change on at least one of the distinct areas.

17. The physical system of claim 15 wherein the processor is further configured to change a color of the electronic display surface upon reception of a computer signal representing a random outcome.

18. The physical system of claim 15 wherein the electronic display surface further comprises an electronic display area for displaying amounts of payouts for existing wagers.

19. The physical system of claim 13 wherein the series of sequential random outcomes comprises one of roulette events, die casting events, and card-based events.

20. The physical system of claim 13 wherein the wager representation reader comprises one of a camera, a video capture, and a radio frequency identification (RFID) reader.

* * * * *